US010065447B2

(12) United States Patent
Paik et al.

(10) Patent No.: US 10,065,447 B2
(45) Date of Patent: Sep. 4, 2018

(54) DRAWING BOOK

(71) Applicant: Grace Paik, Morton Grove, IL (US)

(72) Inventors: Grace Paik, Morton Grove, IL (US); Steven Gottlieb, Warrenton, VA (US)

(73) Assignee: Le Petit Bleu, LLC, San Francisco, CA (US)

( * ) Notice: Subject to any disclaimer, the term of this patent is extended or adjusted under 35 U.S.C. 154(b) by 200 days.

(21) Appl. No.: 15/174,965

(22) Filed: Jun. 6, 2016

(65) Prior Publication Data

US 2017/0348999 A1 Dec. 7, 2017

(51) Int. Cl.
*B43L 1/00* (2006.01)
*B42D 1/00* (2006.01)

(52) U.S. Cl.
CPC ..... *B43L 1/002* (2013.01); *B42D 1/003* (2013.01)

(58) Field of Classification Search
USPC ..... 434/81, 85, 408, 413, 414, 415, 425; 281/15.1, 21.1, 28, 38, 39
See application file for complete search history.

(56) References Cited

U.S. PATENT DOCUMENTS 3,497,969 A * 3/1970 Schwoegler ..... B43L 1/08 434/421
4,280,241 A 7/1981 Pfaff
4,978,568 A 12/1990 Postma
5,137,453 A * 8/1992 Hudson ..... A47K 3/281 24/306
5,464,253 A 11/1995 Farrell
6,061,943 A * 5/2000 Pepys ..... B42D 1/08 281/38
6,364,360 B1 * 4/2002 Kaufman ..... A63H 33/38 281/15.1
6,712,396 B2 * 3/2004 Derraugh ..... B42D 1/003 281/21.1
6,773,034 B1 * 8/2004 Melcher ..... B42C 9/00 281/15.1
7,144,044 B2 * 12/2006 Legrand ..... B42D 1/003 281/15.1
7,144,254 B2 * 12/2006 Meyerrose ..... B43K 23/001 434/408
7,258,367 B2 * 8/2007 Legrand ..... A63H 33/38 281/15.1
8,376,408 B2 2/2013 Legrand
8,603,621 B2 12/2013 Tetrault
2005/0230955 A1 * 10/2005 Mashimo ..... B42D 1/008 281/21.1
2009/0039637 A1 2/2009 Burrows
2009/0206590 A1 8/2009 Gerth
2013/0280691 A1 10/2013 O'Connor
2015/0056599 A1 2/2015 O'Connor

* cited by examiner

*Primary Examiner* — Kurt Fernstrom

(57) ABSTRACT

An erasable, polymeric paged writing book for small children, with textured, flexible, bordered pages and an internal spine to spread the book flat. The pages have rounded corners. The book closes by hook-and-loop tab. The pages have a smaller profile than the covers, for resistance to wear and distortion. A fold-away pocket holds chalk and grease pencils. Optionally, a pleated storage compartment is on one of the covers. The pages have a smaller profile than the covers, for resistance to wear and distortion.

20 Claims, 2 Drawing Sheets

DRAWING BOOK

FIELD OF THE INVENTION

The present disclosure relates to drawing materials, and more particular, to a writing and drawing substrate in book form, with erasable pages.

BACKGROUND OF THE INVENTION

From time to time, it is desirable to provide small children with ways to amuse themselves. One of the ways is to provide a reusable writing surface capable of receiving markings thereon, being erased, and subsequently reused. It would further be desirable to have the writing surface in the form of a book, to promote positive feelings towards books by small children.

Reusable, erasable writing surfaces and books have been proposed. However, many of these do not address aspects of use which are encountered by small children, but not by older children and adults.

There remains a need for an erasable marking book particularly suited to the needs of small children.

SUMMARY

The disclosed concepts address the above stated situation by providing a markable, erasable book having characteristics suited for use by small children. To this end, the novel drawing book disclosed herein has mildly flexible polymeric pages which are liquid resistant and which will yield if for example a child sits on a page when seated on an upholstered or cushioned surface. The exterior of the drawing book may have a woven, rubbery surface so it will not readily slip from a child's grasp, and to impart a unique tactile identity to facilitate the drawing book being retrieved by a caregiver from bags and other receptacles storing accessories and materials unrelated to the drawing book, and to reassure the child that he or she has grasped the drawing book and not some other object.

The drawing book may have rounded corners, with corners of interior pages recessed within the bounds of the covers of the drawing book, to minimize the likelihood of the child poking himself or herself with sharp corners. Also, over time and with repeated use, the pages may become misaligned with the covers. If not recessed within the bounds of the covers, some pages could come to stick out objectionably. Further, recessed pages are more easily located and turned by small children, who might otherwise grasp a cover rather than the desired page.

The drawing book may have fabric borders greater in thickness than the marking receiving portion of the page to provide small children with a sense of where the boundary of each page is located. Also, liquid markers and inks and chalk can leave residues which bleed, or migrate beyond the page. A relatively thick fabric border intercepts these migrating materials and helps prevent fouling the child's clothing and other environmental surfaces. Thickened borders also reinforce pages, for example by opposing folding of corners and fraying of page edges over time and with use. Also, thickened borders help very young children learn motor skills related to turning the pages.

The drawing book may include an interior spine which promotes spreading apart of pages, thereby causing the book to lie flat when placed on a horizontal surface.

Interior pages are made from a liquid resistant polymeric material textured to abrade a writing material such as chalk and grease pencil, and to retain abraded writing material so that indicia remains visible until erased.

The nature of the disclosed concepts will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION OF THE EMBODIMENTS

Figure 2:
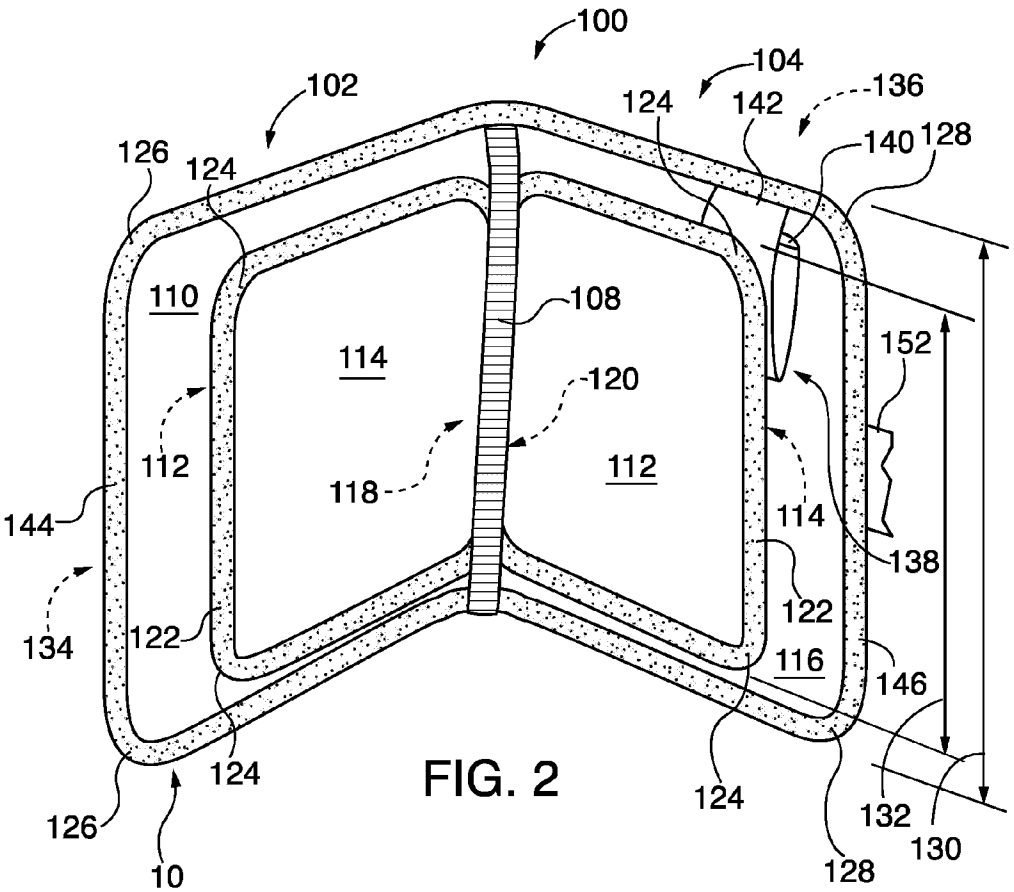
FIG. 2 is a schematic perspective view of an erasable writing book, shown with pages spread open to reveal internal detail, according to at least another aspect of the disclosure.
Figure 1:
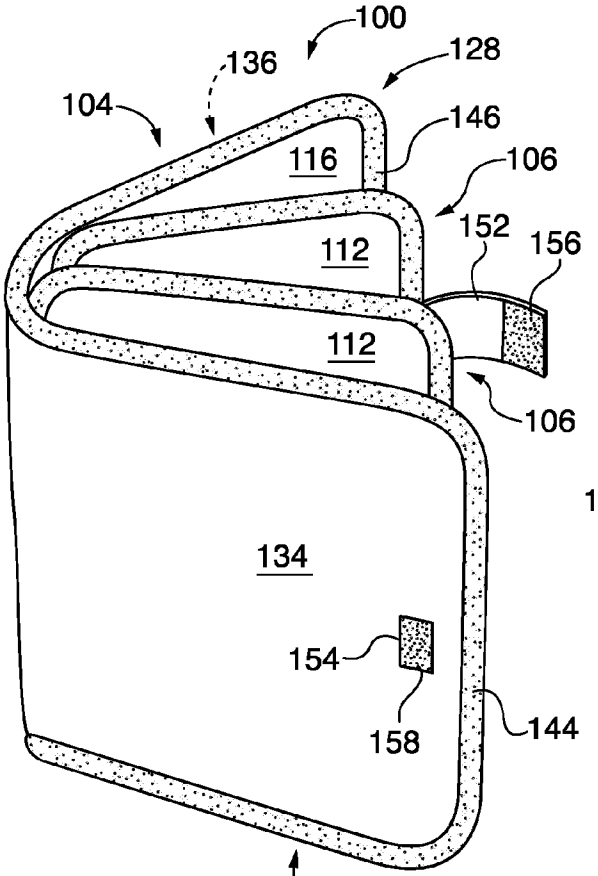
FIG. 1 is a schematic perspective side view of an erasable writing book, according to at least one aspect of the disclosure.

Referring first to FIGS. 1 and 2, according to at least one aspect of the disclosure, there is shown an erasable writing book 100 for erasably accepting indicia from writing materials such as chalk and grease pencils (neither shown). Erasable writing book 100 comprises a front cover 102, a rear cover 104, at least one interior page 106, and at least one interior spine 108. Front cover 102 comprises an interior face 110 bearing a flexible, liquid resistant polymeric substance including texturing thereon for abrading the writing materials and retaining abraded writing materials thereon. The at least one interior page 106 comprises opposed front and rear faces 112, 114 each bearing a flexible, liquid resistant polymeric substance including texturing thereon for abrading writing materials such as chalk and grease pencils and retaining abraded writing materials thereon. Rear cover 104 comprises an interior face 116 bearing a flexible, liquid resistant polymeric substance including texturing thereon for abrading writing materials such as chalk and grease pencils and retaining abraded writing materials thereon. One interior spine 108 overlies two adjacent ones of edges 118, 120 of two respective interior pages 106 and an edge 118 or 120 of interior page 106, one of an edge 122 of interior face 110 of front cover 102, and interior face 116 of rear cover 104. Interior spine 108 exerts a force spreading apart interior pages 106 or spreading apart interior page 106 and interior face 110 (or 116) of front cover 102 (or of rear cover 104), whereby manual effort to maintain erasable writing book 100 flat is minimized.

Writing materials may include liquid inks (not shown) as well as chalk and grease pencils. In some embodiments (not shown), interior spine 108 may be supplemented by other interior spines (not shown) between other interior pages 106, between interior face 110 of front cover 102 and an interior page 106, or between an interior page 106 and interior face 116 of rear cover 104.

The flexible, liquid resistant polymeric substance may be any suitable polymeric material heat treated or molded to include texturing thereon for abrading and retaining writing materials thereon. Texturing may be of characteristics of a dried coat of wrinkle paint, for example. Flexibility is sufficient to squirm under the weight of a child sitting on an open page while seated on an upholstered or cushioned chair, but not to enable a page to slump spontaneously if held by an edge for example.

In embodiments wherein erasable writing book 100 comprises at least two interior pages 106, interior spine 108 may extend along the full length of the two adjacent edges 118, 120 of two respective interior pages 106. This arrangement reinforces connection of interior pages 106, which would otherwise be susceptible to eventual damage after long usage by youngsters.

Each interior page 106 may comprise a fabric-like border 122 thicker than the rest of interior page 106. Fabric-like border 122 may be of woven fabric, unwoven fabric, or of stitching. Fabric-like border 122 is liquid permeable. This construction and thickness intercept and retain excessive liquid ink deposited by a marker (not shown) being used to mark erasable writing book 100, and will to a degree intercept and retail chalk dust. Fabric-like border 122 may extend along the entire border of each interior page 106. This reinforces each interior page 106 for long term usage by small children, and accommodates tactile recognition of the borders of each interior page 106.

Each interior page 106 may comprise rounded corners 124. Also, front cover 102 may comprise rounded corners 126, and rear cover 104 may comprise rounded corners 128. Rounded corners 124, 126, 128 avoid injuries which could arise from conventional square or sharp corners. Front cover 102 and rear cover 104 comprise a height dimension 130, and each interior page 106 may comprise a height dimension 132 less than height dimension 130 of front cover 102 and rear cover 104. Interior pages 106 are thereby protectively recessed within front and rear covers 102, 104, and will last longer in the hands of small children, especially should the binding (not shown) lose grip of interior pages 106. Also, it will be easier for very small children to grasp interior pages 106. Without interior pages 106 being recessed, a very small child might be more likely to grasp front cover 102 or rear cover 104.

Front cover 102 may include an exterior face 134 bearing rubberized fabric. Rear cover 104 may include an exterior face 136 bearing rubberized fabric. Woven rubberized fabric resists slipping from a child's hand. Also, woven rubberized fabric imparts tactile identity to facilitate identifying erasable writing book 100 should it be underneath furniture or be retrieved from a bag, suitcase, or other receptacle where it is buried under or surrounded by other objects. The tactile identity also assists children in identifying erasable writing book 100 by touch, thereby promoting tactile development.

Figures 3, 4, 5:
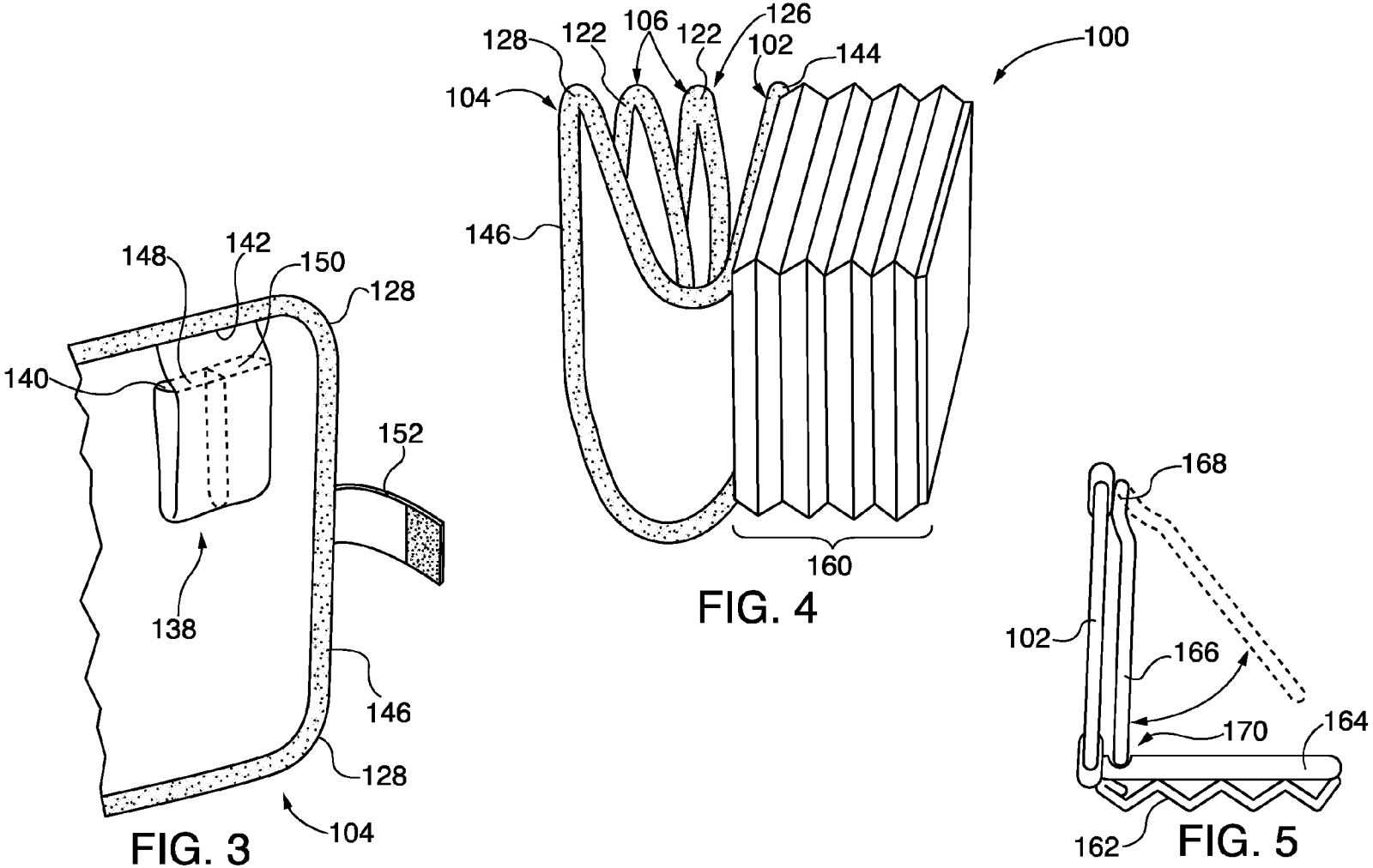
FIG. 3 is a schematic detail side view of the interior of a rear cover of an erasable writing book, according to at least one further aspect of the disclosure.
FIG. 4 is a schematic perspective view of an optional feature of an erasable writing book.
FIG. 5 is a schematic side detail view taken from the center of FIG. 4.

Referring also to FIG. 3, erasable writing book 100 may further comprise a pocket 138 coupled thereto, for storing writing apparatus (such as chalk and grease pencils, not shown). Pocket 138 may comprise an open end 140 for receiving objects (none shown) inserted thereinto and a closed end 142 coupled to erasable writing book 100.

Front cover 102 may comprise a fabric-like border 144 and rear cover 104 may comprise a fabric-like border 146. Erasable writing book 100 may further comprise pocket 138 coupled to fabric-like border 144 or 146 of (respectively) front cover 102 or of rear cover 104. Pocket 138 has open end 140 for receiving objects (not shown) inserted thereinto and closed end 142 coupled to fabric-like border 144 or 146. This arrangement conveniently anchors pocket 138 on erasable writing book 100.

Closed end 142 of pocket 138 may be long enough to be folded over against itself with open end 140 thereof entrapped between closed end 142 and either front cover 102 or rear cover 104. Open end 140 may be covered by closed end 142 such that the objects inserted into pocket 138 are prevented from inadvertent loss by interference with closed end 142. Length of pocket 138 enables pocket 138 to be folded as shown in FIG. 2.

As seen in FIG. 3, pocket 138 may be divided into two compartments 148 each accessible through open end 140. This enables different objects to be segregated from each other. For example, writing materials may be segregated by color or type. Other objects such as keys, coins, and the like may be segregated from writing materials.

Erasable writing book 100 may further comprise a flexible closure tab 152 coupled to one of front cover 102 and rear cover 104, and a complementing attachment element 154 at the other one of front cover 102 and rear cover 104. In the embodiment depicted in FIG. 1, flexible closure tab 152 bears hook and loop fastening material 156 of one polarity, while complementing attachment element 154 bears hook and loop fastening material 158 of an opposite polarity. Flexible closure tab 152 enables erasable writing book 100 to be carried about compactly, while protecting front cover 102, interior pages 106, and rear cover 104 from inadvertent damage.

Interior face 110 of front cover 102, interior face 116 of rear cover 104, and opposed front and rear faces 112, 114 (respectively) of each interior page 106 may be of an intermediate color between the lightest possible rendering of the color and the darkest possible rendering of the color. Considering the example of white, grays, and black, with white being the lightest possible rendering and black being the darkest possible rendering, the intermediate color may be gray. The same principle may be applied to chromatic colors.

In one embodiment of erasable writing book 100, front cover 102 may comprise exterior face 134 including texturing to increase frictional characteristics. Rear cover 104 may comprise exterior face 136 including texturing to increase frictional characteristics. Erasable writing book 100 is easily grasped by a small child in the above embodiment.

With particular reference to FIG. 4, in an embodiment of erasable writing book 100, one of front cover 102 or rear cover 104 may comprise exterior face 134 or 136 (respectively) bearing a storage compartment 160, for storing articles greater in size than those which could fit into pocket 138. Storage compartment 160 may be collapsible, to assume compact configuration when not in use. This may be achieved by fabricating storage compartment 160 as having pleated walls 162, which are manually compressible to collapse storage compartment 160 when no articles are to be stored therein. Where storage compartment 160 is collapsible, storage compartment 160 may include structure making it relatively rigid. For example, and referring also to FIG. 5, storage compartment 160 of claim 19, may further comprise bracing selectively enabling storage compartment 160 to be maintained in a distended condition. In the example of FIG. 5, bracing comprises a first rigid panel 164 and a second rigid panel 166. Second rigid panel 166 is coupled to front cover 102 by a hinge 168 enabling second rigid panel 166 to pivot relative to front cover 102. Second rigid panel 166 may be manipulated to occupy a groove 170 in first rigid panel 164 to maintain storage 160 in the distended condition shown in FIG. 4. When it is desired to collapse storage compartment 160, second rigid panel 166 may be manipulated out of engagement with groove 170.

Unless otherwise indicated, the terms "first", "second", etc., are used herein merely as labels, and are not intended to impose ordinal, positional, or hierarchical requirements on the times to which these terms refer. Moreover, reference to, e.g., a "second" item does not either require or preclude the existence of, e.g., a "first" or lower-numbered item, and/or, e.g., a "third" or higher-numbered item.

While the present invention comprises been described in connection with what are considered the most practical exemplary embodiments, it is to be understood that the present embodiments are not to be limited to the disclosed arrangements, but rather the description is intended to cover various arrangements which are included within the spirit and scope of the broadest possible interpretation of the appended claims so as to encompass all modifications and equivalent arrangements which are possible.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

What is claimed:

1. An erasable writing book for erasably accepting indicia from writing materials, the erasable writing book comprising a front cover, a rear cover, at least one interior page, and at least one interior spine, wherein:

the front cover comprises an interior face bearing a flexible, liquid resistant polymeric substance including texturing thereon for abrading the writing materials and retaining abraded writing materials thereon;

the at least one interior page comprises opposed front and rear faces each bearing a flexible, liquid resistant polymeric substance including texturing thereon for abrading writing materials and retaining abraded writing materials thereon;

the rear cover comprises an interior face bearing a flexible, liquid resistant polymeric substance including texturing thereon for abrading writing materials and retaining abraded writing materials thereon; and one of the at least one interior spine overlies two adjacent ones of edges of two respective interior pages and an edge of the interior page, one edge of the interior face of the front cover, and the interior face of the rear cover, and the interior spine exerts a force spreading apart the interior pages or spreading apart the interior page and the interior face of the front cover or of the rear cover, whereby manual effort to maintain the erasable writing book flat is minimized.

2. The erasable writing book of claim 1, wherein the erasable writing book comprises at least two interior pages, and the interior spine extends along the full length of the two adjacent edges of two respective interior pages.

3. The erasable writing book of claim 1, wherein each said interior page comprises a fabric border thicker than the rest of the interior page.

4. The erasable writing book of claim 3, wherein the fabric border extends along the entire border of each said interior page.

5. The erasable writing book of claim 3, wherein the fabric border is liquid permeable.

6. The erasable writing book of claim 1, wherein each said interior page comprises rounded corners, the front cover comprises rounded corners, and the rear cover comprises rounded corners.

7. The erasable writing book of claim 1, wherein the front cover and the rear cover comprise a height dimension, and each said interior page comprises a height dimension less than the height dimension of the front cover and the rear cover.

8. The erasable writing book of claim 1, wherein the front cover includes an exterior face bearing rubberized fabric, and the rear cover includes an exterior face bearing rubberized fabric.

9. The erasable writing book of claim 1, further comprising a pocket coupled to the erasable writing book, for storing writing apparatus, the pocket comprising an open end for receiving objects inserted thereinto and a closed end coupled to the erasable writing book.

10. The erasable writing book of claim 1, wherein the front cover comprises a fabric border and the rear cover comprises a fabric border.

11. The erasable writing book of claim 10, further comprising a pocket coupled to the fabric border of the front cover or of the rear cover, the pocket having an open end for receiving objects inserted thereinto and a closed end coupled to the fabric border.

12. The erasable writing book of claim 11, wherein the closed end of the pocket is long enough to be folded over against itself with the open end thereof entrapped between a the closed end and either the front cover or the rear cover, and with the open end covered by the closed end such that the objects inserted into the pocket are prevented from inadvertent loss by interference with the closed end.

13. The erasable writing book of claim 11, wherein the pocket is divided into two compartments each accessible through the open end.

14. The erasable writing book of claim 1, further comprising a flexible closure tab coupled to one of the front cover and the rear cover, and a complementing attachment element at the other one of the front cover and the rear cover.

15. The erasable writing book of claim 1, wherein the interior face of the front cover, the interior face of the rear cover, and the opposed front and rear faces of each said interior page is of an intermediate color between the lightest possible rendering of the color and the darkest possible rendering of the color.

16. The erasable writing book of claim 15, wherein the intermediate color is gray.

17. The erasable writing book of claim 1, wherein the front cover comprises an exterior face including texturing to increase frictional characteristics, and the rear cover comprises an exterior face including texturing to increase frictional characteristics, whereby the erasable writing book is easily grasped by a small child.

18. The erasable writing book of claim 1, wherein one of the front cover or the rear cover comprises an exterior face bearing a storage compartment.

19. The erasable writing book of claim 18, wherein the storage compartment is collapsible.

20. The erasable writing book of claim 19, further comprising bracing selectively enabling the storage compartment to be maintained in a distended condition.

* * * * *